US009821944B1

(12) United States Patent
Russell et al.

(10) Patent No.: US 9,821,944 B1
(45) Date of Patent: Nov. 21, 2017

(54) PACKAGE DECELERATION AND PROTECTION SYSTEMS

(71) Applicant: Amazon Technologies, Inc., Reno, NV (US)

(72) Inventors: Paul Grady Russell, Campbell, CA (US); Paul Clayton Marchetti, Campbell, CA (US); Alexander James Parker, San Jose, CA (US); Joselito Tansingco Crespo, Burlingame, CA (US); John Kelly Cornell, Campbell, CA (US); Patrick Dean Lewis, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 1027 days.

(21) Appl. No.: 13/919,597

(22) Filed: Jun. 17, 2013

(51) Int. Cl.
*B65B 23/00* (2006.01)
*B65D 81/02* (2006.01)

(52) U.S. Cl.
CPC ..... *B65D 81/02* (2013.01); *B65B 23/00* (2013.01)

(58) Field of Classification Search
CPC A63B 5/11; B65B 5/101; B65B 35/12; B65B 39/00
USPC ..... 53/248, 475
See application file for complete search history.

(56) References Cited

U.S. PATENT DOCUMENTS 1,309,328 A * 7/1919 McClymonds .... A47G 29/1209 232/47
2,604,933 A * 7/1952 Karg ..... A47C 7/282 182/139
3,732,961 A * 5/1973 Thornton ..... A01D 46/00 193/15
3,892,403 A * 7/1975 Green ..... A63B 5/11 182/139
4,250,690 A * 2/1981 Lorenzen ..... B65B 5/108 414/794
5,069,379 A * 12/1991 Kerrigan ..... B25C 1/06 227/120
5,082,171 A * 1/1992 Homel ..... E05G 7/001 232/43.1
5,325,653 A * 7/1994 Boyd ..... B65B 25/046 141/128
5,724,415 A * 3/1998 Mills ..... G07F 9/06 194/310
6,572,293 B1 * 6/2003 Motamed ..... B65H 31/10 271/219
7,455,179 B2 * 11/2008 Bringard ..... B65D 19/20 206/386
9,156,574 B2 * 10/2015 Tobin ..... B65B 35/12
2008/0078827 A1 * 4/2008 Geiss ..... B29C 45/7686 235/375

* cited by examiner

*Primary Examiner* — Thanh Truong
*Assistant Examiner* — Patrick Fry
(74) *Attorney, Agent, or Firm* — Lee & Hayes, PLLC

(57) ABSTRACT

This disclosure describes, in part, systems and methods for package deceleration and protection while packages are loaded into a bulk box. The packaging assembly includes an interference mechanism attached to a bulk box (e.g., a Gaylord container) by multiple elastic members. As packages are dropped into the bulk box, each package contacts the interference mechanism and the elastic members dampen the kinetic energy of the falling package, thereby reducing its velocity before the package continues into the bulk box.

20 Claims, 10 Drawing Sheets

PACKAGE DECELERATION AND PROTECTION SYSTEMS

BACKGROUND

Product distribution centers process vast quantities of products for shipment to consumers. To process such vast quantities of products, distribution centers utilize mechanical handling equipment (e.g., conveyor systems) which can be rough on the products. For example, a distribution center (e.g., a fulfillment center) may transport a variety of different products via a conveyor system to be dispensed into a bulk box (e.g., a Gaylord container). The bulk box filled with product is subsequently shipped to a package delivery company which then delivers the product to consumers. While this approach may be efficient in helping deliver product to a consumer in a short period of time, it may be rough and susceptible to yielding damaged products. For instance, a product may sustain damage as a result of a high drop impact as the product falls from the end of the conveyor system into the base of the bulk box. In another situation, a product may be damaged by having other packages fall on it. For example, suppose an electronic device with a flat screen display is packaged its own container and is dropped into a bulk box. Subsequently, another product, such as a case of canned goods, falls from the conveyor system and lands on the packaging of the electronic device. This impact may damage the electronic device by, for example, cracking or otherwise harming the flat screen display. In either event, such product handling may result in damage to certain products and ultimately a delay in delivering products to consumers. Existing methods for protecting products from damage during handling at a distribution center may include adding additional packaging materials and/or bulk to each product's shipping container.

Accordingly, there remains a need for improved systems and methods of handling products in a distribution center that reduce the potential for damaged products and increases efficiency in delivering products to a consumer, while minimizing costs associated with the additional packaging material of each product's shipping container.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Overview

Figure 1:
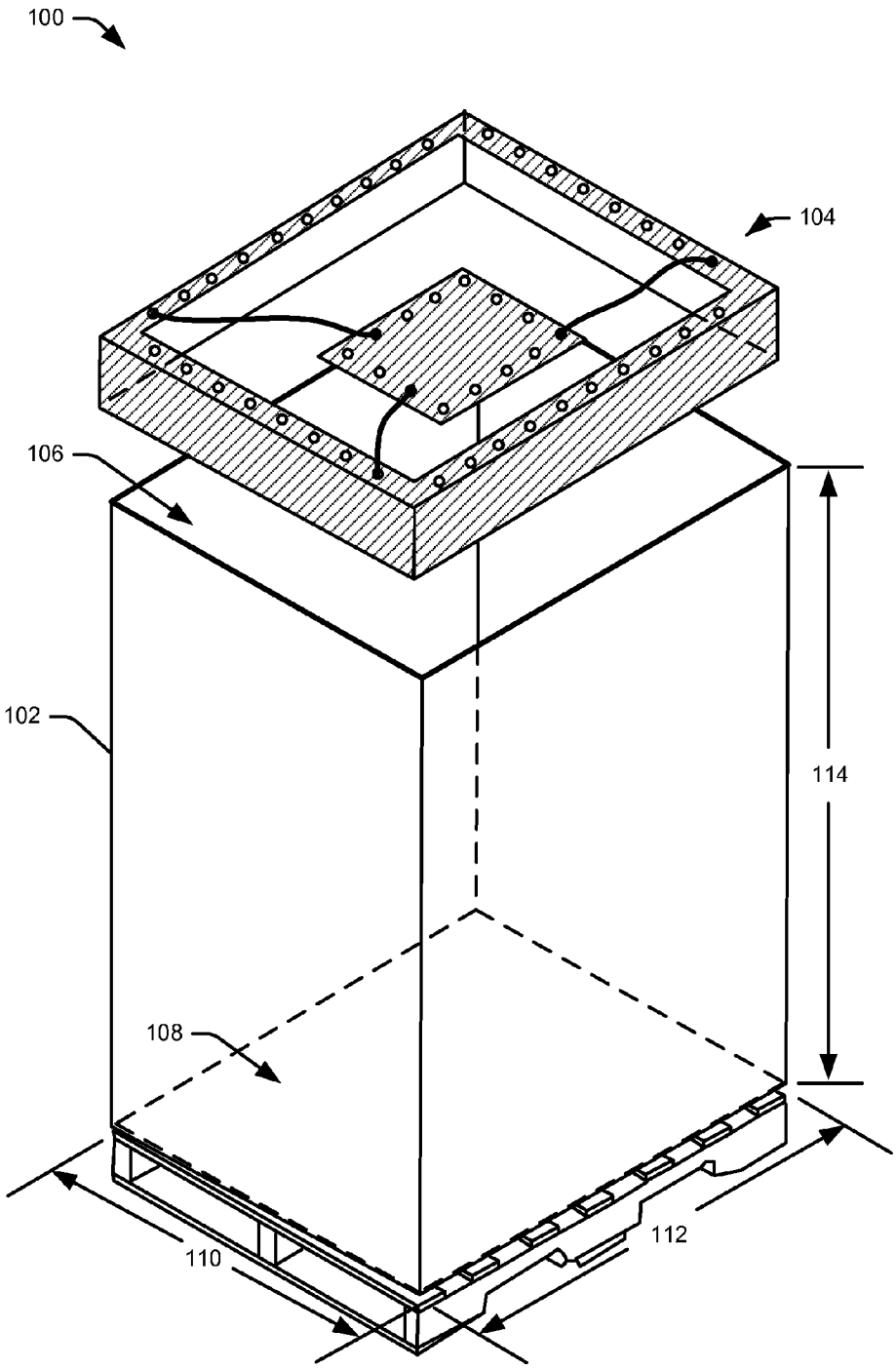
FIG. 1 illustrates an example package deceleration and protection system comprising a bulk box and an example packaging assembly with a package interference mechanism.

This disclosure describes, in part, systems and methods for package deceleration and protection. In some implementations, a packaging assembly may have an interference mechanism, drop arrestor or platten member attached to a bulk box (e.g., a Gaylord container) to dampen a kinetic energy of a package as the package is dropped into the bulk box.

In one implementation, the packaging assembly may comprise a frame or cap to fit over a top perimeter of the bulk box. In some implementations, the frame may have an internal lip or flange configured to rest on the top perimeter of the bulk box. In addition, some implementations describe that the frame may have one or more sidewalls extending perpendicular to the internal lip and, in some implementations, configured to secure the frame over the over an the outside perimeter of the opening of the bulk box.

In some implementations, an interference mechanism, drop arrestor or platten member may be attached to the internal lip or a sidewall of the frame by two or more elastic members. The interference mechanism having a contact surface positioned to receive one or more packages as they enter the bulk box. In some implementations, both the frame (internal lip or sidewall) and the margins of the interference mechanism may have two or more attachment points for attachment of each end of the two or more elastic members.

In some implementations, when each package enters the bulk box by passing through the frame making contact with the contact surface of the interference mechanism, a kinetic energy of each package may be absorbed by an extension of the two or more elastic members.

In other implementations, a packaging assembly may comprise two or more elastic members or extendable attachment mechanisms having a first end and a second end, the first end may be configured to interact with a top edge of a bulk box. In some implementations, the first end of the attachment mechanisms may be configured with a clip, connector, clamp, adapter, coupling, fastener or tie for securing each attachment mechanism to the top edge of the bulk box. The second end of each attachment mechanism configured to fasten to an interference mechanism, drop arrestor or platten member positioned inside the top border of the bulk box.

In some implementations, a packaging assembly may comprise a bulk box modified to have two or more attachment points or eyelets located around a top perimeter of the bulk box. In this implementation, the packaging assembly may also comprise two or more elastic member configured to couple the top perimeter of the bulk box with an interference mechanism, drop arrestor or platten member.

In some implementations, the interference mechanism, drop arrestor or platten member comprises a contact surface configured to contact one or more packages received by the bulk box. Moreover, in some implementations, the two or more elastic members may extend and retract in varying lengths to absorb the kinetic energy of each package as the package contacts the contact surface of the platten member.

In some implementations, the two or more elastic members may return to a position held prior to any package making contact with the contact surface of the platten member.

Packaging assemblies having an interference mechanism, drop arrestor or platten member may be quickly and easily employed in a distribution center and, thus, increase the efficiency of the distribution center. For example, a user may place a packaging assembly over the top opening of a bulk box and position the interference mechanism, drop arrestor or platten member such that packages dropped from a conveyor system may contact any portion of the interference mechanism, drop arrestor or platten member. As such, the kinetic energy of the packages dropped from the conveyor system into the bulk box may be dampened or decelerated as they contact any portion of the interference mechanism, drop arrestor or platten member. The result may also yield a reduction in damage accrued by products within the package as they are dropped into the bottom of the bulk box or as other packages are dropped on packages already within the bulk box.

While this disclosure describes packages comprising a single item packaged to be shipped in its own container, the package may be of multiple items packaged to be shipped together. Further, the items may be any type of goods to be distributed to retailers, wholesalers, or directly to customers. For example, a distribution center may handle and process in excess of four million products for shipment to consumers. In some implementations, the items may be electronics (e.g., computers, electronic book devices, media players, etc.) or other items packaged to be shipped in its own container.

The techniques for package deceleration and protection may be implemented in many ways. Example implementations are provided below with reference to the figures.

Example Package Deceleration and Protection Systems

FIG. 1 is an illustrative example of a package deceleration and protection system 100 including a bulk box 102 and a packaging assembly 104. In some implementations, bulk box 102 may be formed of wood, metal, plastic, paper, composite, etc. In one example, the bulk box 102 may be formed of a corrugated material. For example, the bulk box 102 may be formed of a corrugated fiberboard (e.g., single wall, double wall, or triple wall corrugate fiberboard), a corrugated plastic, or a combination of the like (e.g., a corrugated plastic bottom and a corrugated fiberboard top). The bulk box 102 may be a bulk bin, a skid box, a tote box, a Gaylord box, or any other suitable bulk container. The bulk box 102 provides a suitable receptacle for storing and/or shipping vast quantities of various products. For example, a distribution center (e.g., a fulfillment center) of a retailer, may use bulk box 102 to ship quantities of a variety of products to a package delivery company where the package delivery company then ships the products as single shipments to customers. As shown in FIG. 1, the bulk box 102 may be placed on a pallet for ease of movement; however, in other implementations, the bulk box 102 may be placed directly on the floor or on wheels.

In some implementations, the bulk box 102 may have an opening 106 opposite the bottom 108. The bottom 108 of the bulk box 102 may have a width 110 of about 33 inches (84 centimeters) and a length 112 of about 38 inches (96.5 centimeters). Further, the opening 106 may have about the same dimensions as the bottom 108. For example, the opening 106 may have a width of about 33 inches (84 centimeters) and a length of about 38 inches (96.5 centimeters). In some implementations, the bulk box 102 may have a height 114 within a range of about 72 inches to 96 inches (182.8 centimeters to 243.8 centimeters). However, in other implementations, the dimensions, proportions, shape, and configuration of the bulk box 102 may vary depending on a variety of factors, such as the product to be shipped, the volume of the product to be shipped, the size, shape, and layout of a facility of the distribution center, and requirements of the shipper. For example, the bulk box 102 or opening 106 thereof may be circular shaped, octagonal shaped, square shaped, etc.

In some implementations, the packaging assembly 104 may be configured to couple to a top perimeter of the bulk box 102. The packaging assembly 104 may include various components configured to make contact with packages as they are dropped into opening 106 of the bulk box 102. Kinetic energy of each dropped package may be decreased as a result of the contact with the packaging assembly 104 thus decreasing potential damage to the package as each package impacts the bottom 108 the bulk box 102 and/or another package within bulk box 102. In other words, the package assembly may serve to break the fall of packages as each are dropped from a conveyor system into the bulk box 102. Further details regarding implementations of the packaging assembly and components thereof, are discussed in further detail below with reference to FIGS. 2-9.

Figure 2:
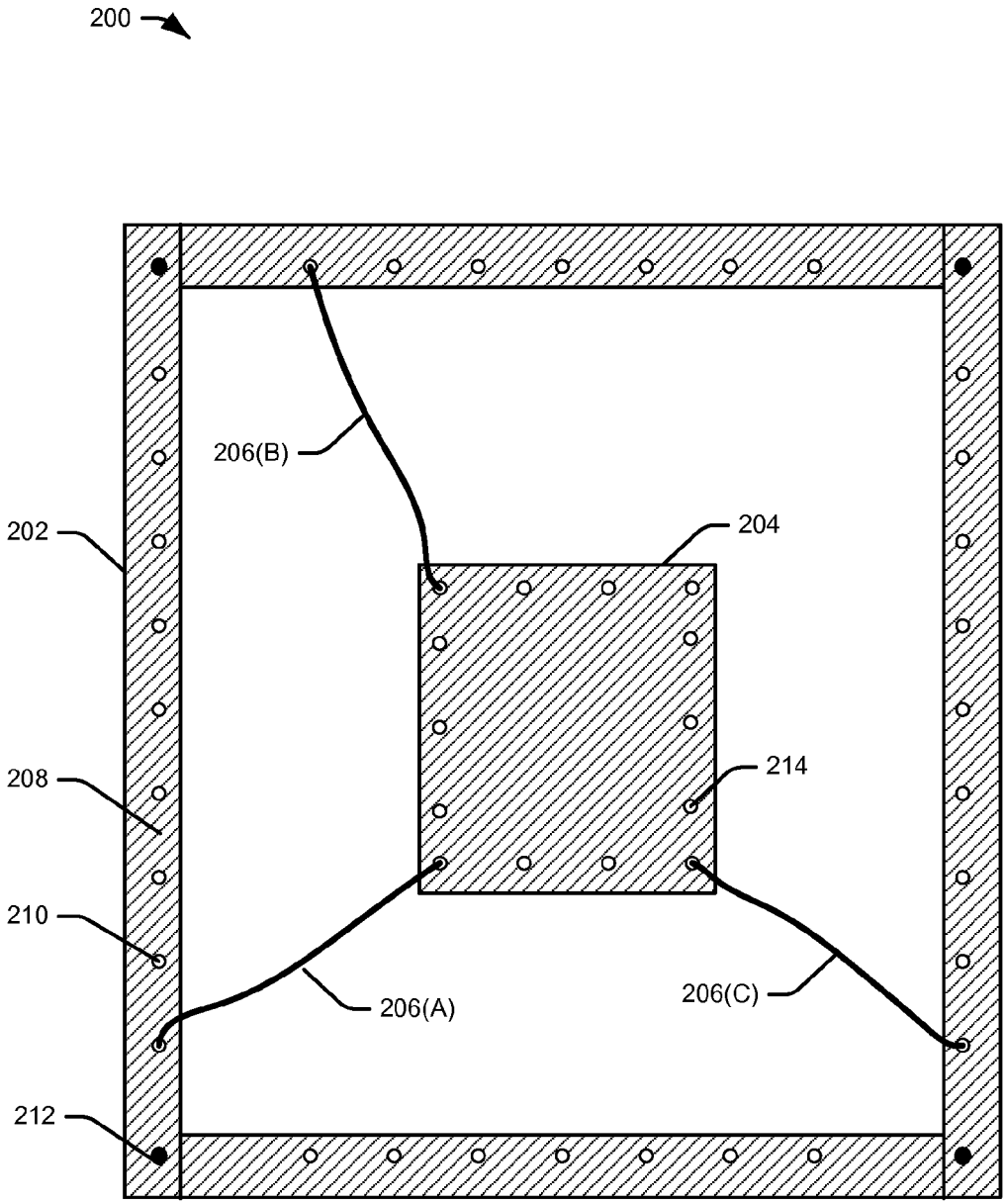
FIG. 2 illustrates an example configuration of a packaging assembly where a package interference mechanism is attached to an internal lip of a frame at three sides.

FIG. 2 illustrates a top view of an example configuration of a packaging assembly or bulk box cap 200 with a frame 202, an interference mechanism 204, and multiple elastic members 206(A)-(C) that suspend the interference mechanism 204 within an opening defined by the frame 202. In some implementations, the frame 202 may be formed of wood, metal (e.g., steel, aluminum, etc.), plastic (e.g., corrugated plastic, rigid plastic), etc. While, in some implementations, the interference mechanism 204 may be formed of plastic (e.g., corrugated plastic, rigid plastic), wood, metal (e.g., steel, aluminum, etc.), fabric, canvas, or other pliable material. In some implementations, the frame 202 and the interference mechanism 204 may be formed of the same material; however, in other implementations, the frame 202 and the interference mechanism 204 may be formed of different materials.

Frame 202 may comprise an internal lip or flange 208. The internal lip 208 may be configured to rest horizontally on the top perimeter of the bulk box. In some implementations, the internal lip 208 may extend from each side of the frame 202. In other implementations, the internal lip 208 may extend from less than all of the sides of the frame 202. For example, a frame having four sides may have an internal lip on only two opposite sides. In some implementations, internal lip 208 may have multiple attachment points 210.

FIG. 2 illustrates the internal lip 208 having eight attachment points 210 on two opposing sides, while having seven attachment points on the other two opposing sides. However, in other implementations, the number of attachment points of the internal lip 208 may vary depending on a variety of factors, such as the size of the frame and/or bulk box.

In some implementations, the frame 202 may be one piece (i.e., all sides of the frame may be one piece of material). However, as illustrated in FIG. 2, the frame 208 may comprise four separate sides held together by fastener 212 at a confluence of the adjacent sides.

In some implementations, the frame 202 may comprise one or more sidewalls (not shown). The sidewall may be configured to extend vertically over an outside perimeter of the bulk box and hold the packaging assembly in place on the bulk box. In some implementations, the sidewalls may extend perpendicular in either direction from a location where the internal lip of the frame is attached. In other implementations and as discussed below, the sidewalls may be configured with two or more attachment points for attachment of two or more elastic members.

FIG. 2 further illustrates an example interference mechanism, drop arrestor or platten member 204 located internal to the internal lip 208 of frame 202. The interference mechanism 204 may be configured with multiple attachment points 214 for connection to the multiple elastic members 206(A)-(C). The attachment points 214 (and attachment points 210) are illustrated generally as circular eyelets in the interference mechanism 204 (or internal lip 208 of frame 202), however, in some implementations, the attachment points may be squares, octagons, or any other suitable shape for attaching the elastic members. The top view of interference mechanism 204 is shown in FIG. 2 comprising a substantially rectangular shape; however, other suitable shapes are imagined to match a corresponding shape of an opening of a bulk box (e.g., square, circular, oval, octagonal, trapezoidal, etc.).

As illustrated in FIG. 2, the interference mechanism 204 may be adjustably positioned within the frame 202 of the packaging assembly 200. Interference mechanism 204 may be oriented such that when a package is dropped from a conveyor system at the distribution center into the opening of the bulk box, the package may strike or otherwise make contact with the interference mechanism 204. In some implementations, the interference mechanism 204 may hang down into the opening of the bulk box as the frame is placed on bulk box.

The packaging assembly 200 shown in FIG. 2 further illustrates the multiple elastic members 206(A)-(C) which may be used to adjustably position the interference mechanism 204 within the frame 202. In some implementations, each of the elastic members may have a first end configured to attach to an attachment point 210 on the internal lip 208 of the frame 202. Furthermore, each of the multiple elastic members may have a second end configured to attach to an attachment point 214 on the interference mechanism 204. The choice of which attachment points, the number of elastic members 206, and/or the lengths of each elastic member contribute to positioning the interference mechanism 204 within the frame 202.

In some implementations, the elastic members 206(A)-(C) may comprise a bungee cord (e.g., a ⅜ inch bungee cord), rubber band, rubber strap, spring or any other non-fixed member that permits a small range of elasticity. In some implementations, the length of each of the elastic member may be the same; however, in other implementation, the lengths of each of the elastic members may vary. For instance, the length of each of the elastic member may determine a distance that the interference mechanism 204 suspends into the opening of the bulk box relative to the frame 202. Further, the amount of elasticity may vary from member to member.

In some implementations and as illustrated in FIG. 2, the position of each of the elastic members 206(A)-(C) is adjustable or variable between any of the multiple attachment points 210 and/or 214 on the frame 202 and the interference mechanism 204 depending on the specific application of the packaging assembly 200.

Figures 3A, 3B, 3C, 3D:
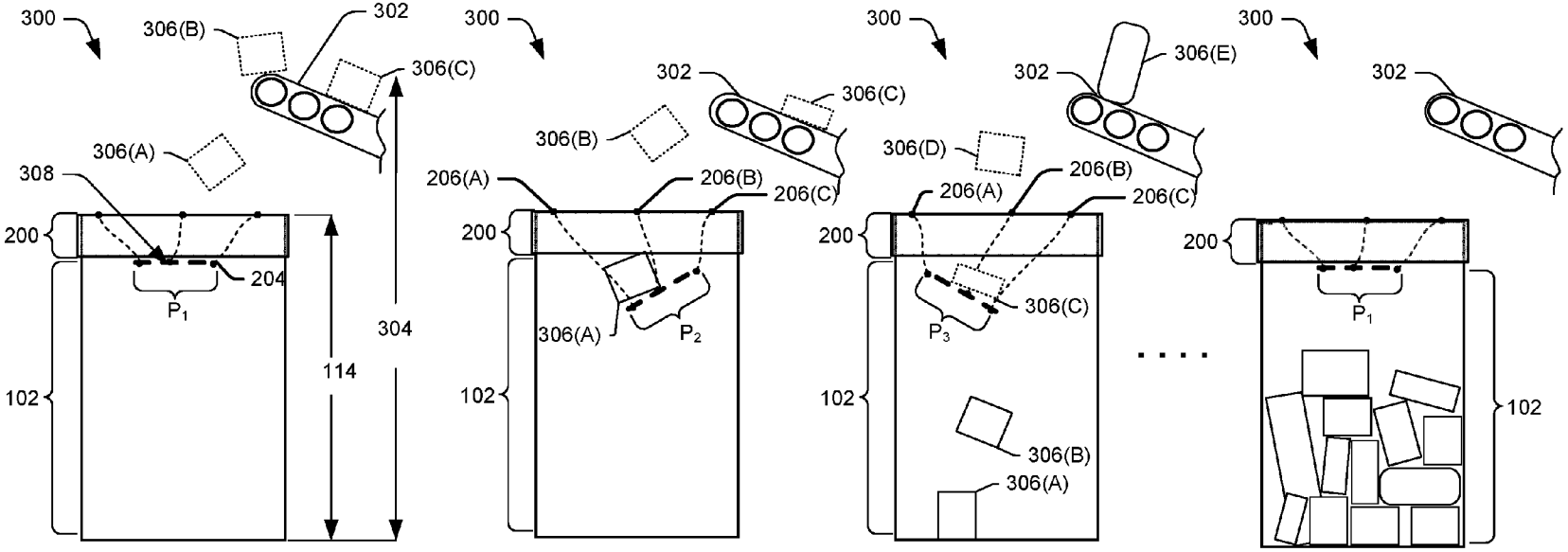
FIGS. 3A-3D illustrate an example environment where an assortment of packages are dropped from a conveyor system into a bulk box using an example packaging assembly illustrated in FIG. 2.

FIGS. 3A-3D illustrate an example environment 300 for the packaging assembly 200 as an assortment of packages are dropped from a conveyor system 302 into the bulk box 102. The various figures show the packaging assembly 200 at different times as the bulk box 102 is filled with different products and sizes of packages. As shown in FIG. 3A, the packaging assembly 200 may be placed onto the bulk box 102. In some implementations, the packaging assembly 200 (or any other packaging assembly discussed throughout) may be coupled to a conveyor system and/or a structure associated with a conveyor system such that the packaging assembly may be positioned over the bulk box with or without contacting the bulk box. For example, the packaging assembly supported by a conveyor system may be lowered, dropped, or swung into a position above the bulk box without contacting the bulk box. In other implementations, the packaging assembly may be affixed to a structure which may completely support the packaging assembly and allow for placement of the packaging assembly independent of the conveyor system or the bulk box.

As shown in FIG. 3A, the bulk box 102 may be positioned such that packages dropped from the conveyor system 302 may contact the interference mechanism 204 of the packaging assembly 200 as the packages fall into the bulk box 102. As described above, the bulk box may have a height 114 of about 72 inches to 96 inches (182.8 centimeters to 243.8 centimeters). The conveyor system 302 may have a height 304 greater than height 114 of the bulk box.

FIG. 3A illustrates the interference mechanism 204 of the packaging assembly 200 at a resting position or position $P_1$ before being contacted by a package 306(A) dropped from the conveyor system 302.

In some implementations, the interference mechanism 204 may change position from position P1 to a position P2 when the package 306(A) dropped from conveyor system 302 contacts the interference mechanism 204, as illustrated in FIG. 3B. The change in position from position P1 to position P2 may be a result of the weight of package placing a downward force on the contact surface 308 of the interference mechanism 204. In some implementations, one or more of the elastic members 206(A)-(C) of the packaging assembly 200 may absorb the downward force of the package 306(A) as it contacts the contact surface 308 of the interference mechanism 204. For example, FIG. 3B illustrates that elastic member 206(A) may extend a substantially greater distance (and absorb a greater energy from the package 306(A)) than elastic member 206(C) as the package 306(A) makes contact with the contact surface 308 of the interference mechanism 204.

Additionally or alternatively, other implementations are envisioned where the change in position from position P1 to position P2 may be a result of the length, placement, or elasticity of each of the elastic member 206(A)-(C). For example, each of the elastic members 206(A)-(C) may be attached to the attachment points of the frame and the interference mechanism such that each package is able to fall in a specific direction as it contacts the contact surface 308 of the interference mechanism.

In some implementations, a kinetic energy, momentum and/or velocity of the package 306(A) may be decreased as each of the multiple elastic members 206(A)-(C) take up a portion of the downward force that the package 306(A) places on the contact surface 308 of the interference mechanism 204.

Once the package 306(A) contacts the contact surface 308 of the interference mechanism 204, the package 306(A) may continue to drop into the bulk box 102. However, due to engaging the interference mechanism 204 during the fall, the package 306(A) has decreased kinetic energy, momentum, and/or velocity. As a result, there is less risk of damage to the package 306(A) as it comes into contact with the bottom of the bulk box 102.

FIG. 3C further illustrates the example environment 300 where additional packages 306(B) and 306(C) have been dropped into the bulk box 102 from conveyor system 302. As illustrated, the interference mechanism 204 of the package assembly 200 may be in position P3 as a result of contact by package 306(C). In some implementations, though not shown, the interference mechanism 204 may in part or in whole return to the resting position (e.g., position P1) while no package is in contact with the contact surface 308 of the interference mechanism.

In some implementations, the change of position of the interference mechanism 204 from position $P_2$ to position $P_3$ (or from position $P_1$ to position $P_3$) may be the result of any of the actions described above with regard to FIG. 3B.

FIG. 3D illustrates the example environment 300 after the assortment of packages have been dropped from the conveyor system 302 through the packaging assembly 200 into bulk box 102. As illustrated, the interference mechanism 204 may return to the resting position (e.g., position $P_1$).

Figure 4:
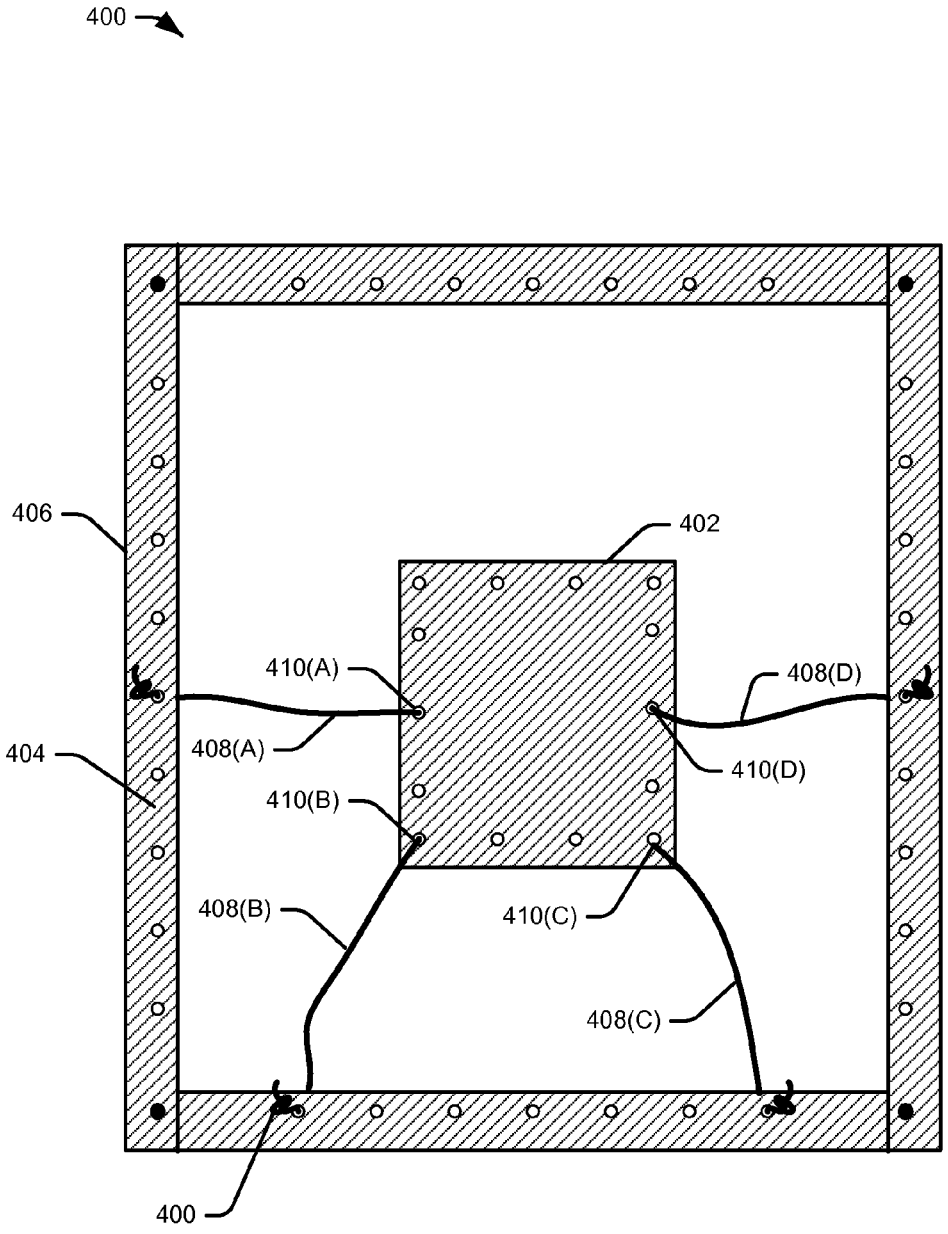
FIG. 4 illustrates an example configuration of a packaging assembly where a package interference mechanism is attached to an internal lip of a frame at two sides.

FIG. 4 illustrates an example configuration of a packaging assembly 400 where a package interference mechanism 402 is configured to attach to an internal lip or flange 404 at two sides of a frame 406. The frame 406 may be configured similarly to frame 202 as described with reference to FIG. 2 above. In some implementations, the packaging assembly 400 may have multiple elastic members 408(A)-(D).

FIG. 4 illustrates that the packaging assembly is configured with four elastic members; however, in other implementations, the packaging assembly may be configured with any number greater than one elastic member. In some implementations, the number of elastic members may be determined by the weight of the packages dropped from the conveyor system, the size of the packages, the elasticity of each elastic member, the size of the interference mechanism, and/or the drop distance from the conveyor system to the interference mechanism, for example.

Furthermore, FIG. 4 illustrates that each elastic member 408(A)-(D) may have a first end 410(A)-(D), respectively, configured to adjustably attach to the one or more attachment points on the interference mechanism 402. In some implementations, each elastic member 408(A)-(D) may also have a second end 412(A)-(D), respectively, configured to adjustably attached to the one or more attachment points on the internal lip 404 of frame 406. As illustrated, the second end 412(A)-(D) of each elastic member 408(A)-(D) may be thread through an attachment point on the internal lip 404 of the frame 406 from the bottom. The second end 412(A)-(D) of each elastic member 408(A)-(D) may be knotted or otherwise prevented from retracting through its respective attachment point when a dropped package comes into contact with the interference mechanism 402.

Figures 5A, 5B, 5C:
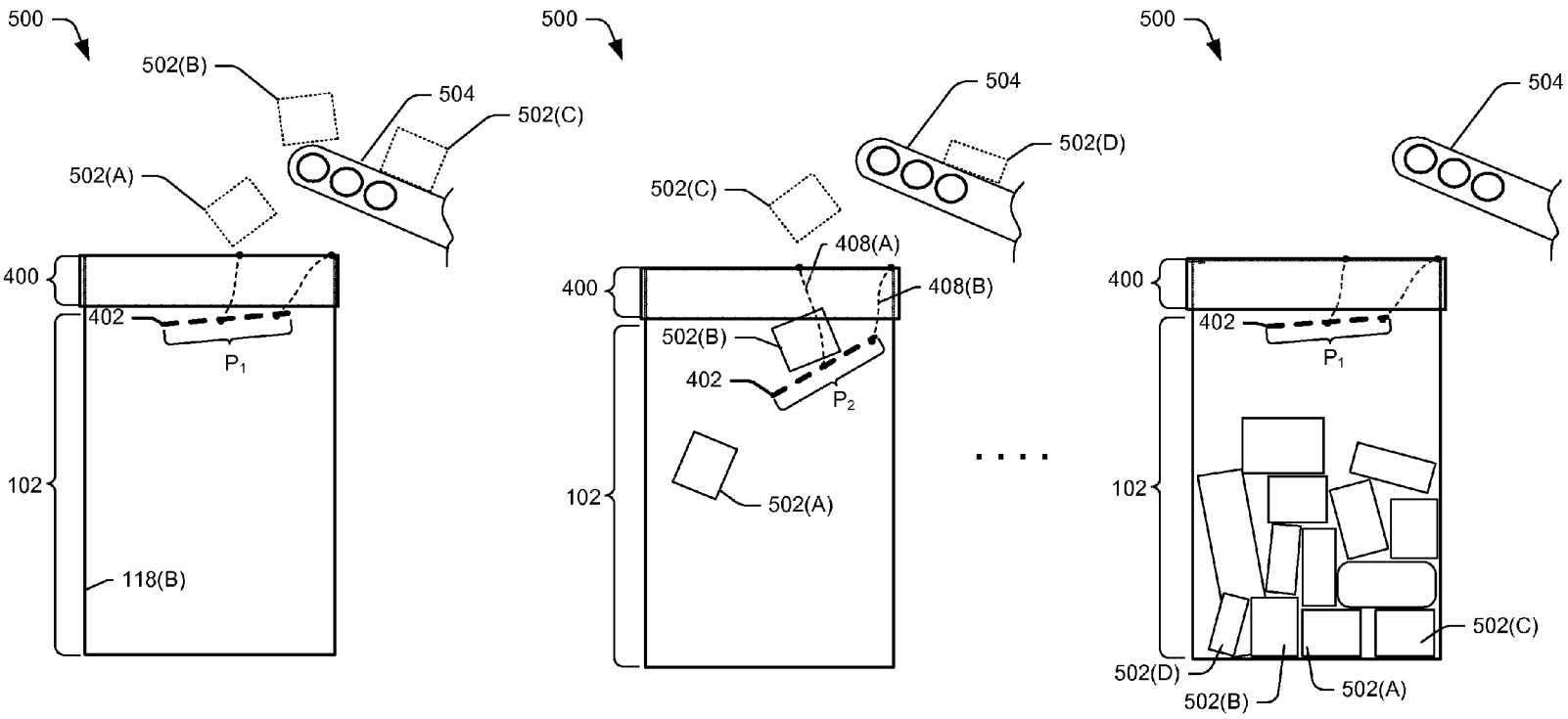
FIGS. 5A-5C illustrate an example environment where an assortment of packages are dropped from a conveyor system into a bulk box using the example packaging assembly illustrated in FIG. 4.

FIGS. 5A-5C illustrate an example environment 500 where packaging assembly 400 of FIG. 4 may be used to decelerate and protect an assortment of packages 502(A)-(N) as they are dropped into a bulk box 102. FIG. 5A illustrates that packaging assembly 400 may be positioned over or placed upon bulk box 102 such that the interference mechanism 402 may hang down into the top perimeter of bulk box 102. Furthermore, the bulk box 102 may be positioned such that packages 502 dropped from the conveyor system 504 may contact the interference mechanism 402 of the packaging assembly 400.

FIG. 5A illustrates the interference mechanism 402 of the packaging mechanism 400 in a resting position or position $P_1$ before being contacted by a package 502(A) dropped from the conveyor system 504. In some implementations, when a package dropped from conveyor system 504 contacts the interference mechanism 402, illustrated as package 502(B) in FIG. 5B, the interference mechanism 402 may change position from position $P_1$ to a position $P_2$. The change in position from position $P_1$ to position $P_2$ may be a result of the weight of package placing a downward force on the contact surface of the interference mechanism 402. In some implementations, one or more of the elastic members of the packaging assembly 400 may absorb the downward force of each package as it contacts the contact surface of the interference mechanism 402. For example, FIG. 3B illustrates that elastic member 408(A) may extend a substantially greater distance (and absorb a greater energy from the package 502(B)) than elastic member 408(B) as the package 502(B) makes contact with the contact surface of the interference mechanism 402. In this way, the elastic members 408(A)-(D) absorb a portion of the force applied by each package 502(A)-(N) on the contact surface of the interference mechanism 402, thereby decreasing the kinetic energy, momentum, and/or velocity of each package 502(A)-(N) as it falls from the conveyor system into the bulk box.

As illustrated in FIG. 5C, after each package 502(A)-(N) hits the contact surface of the interference mechanism 402, each package 502(A)-(N) may continue to drop into the bulk box 102. In some implementations, the interference mechanism 402 returns to a resting position or position $P_1$. Due to the interference mechanism 402, there is less risk of damage to each package 502(A)-(N) as the package comes into contact with the bottom of the bulk box 102 or in contact with another of the packages 502(A)-(N) in the bulk box.

Alternative Package Deceleration and Protection Systems

FIGS. 6-9 illustrate various alternative package deceleration and protection systems. While the implementations described in this section may have a different package assembly configuration than those described above, it is to be understood that each alternative implementation described below has a similar function or purpose to the implementations described above. That is, each implementation may be configured to slow the momentum and/or velocity of the packages as they are dropped into a bulk box, thereby reducing the risk of damage to the falling package or those packages already in the bulk box.

Figure 6:
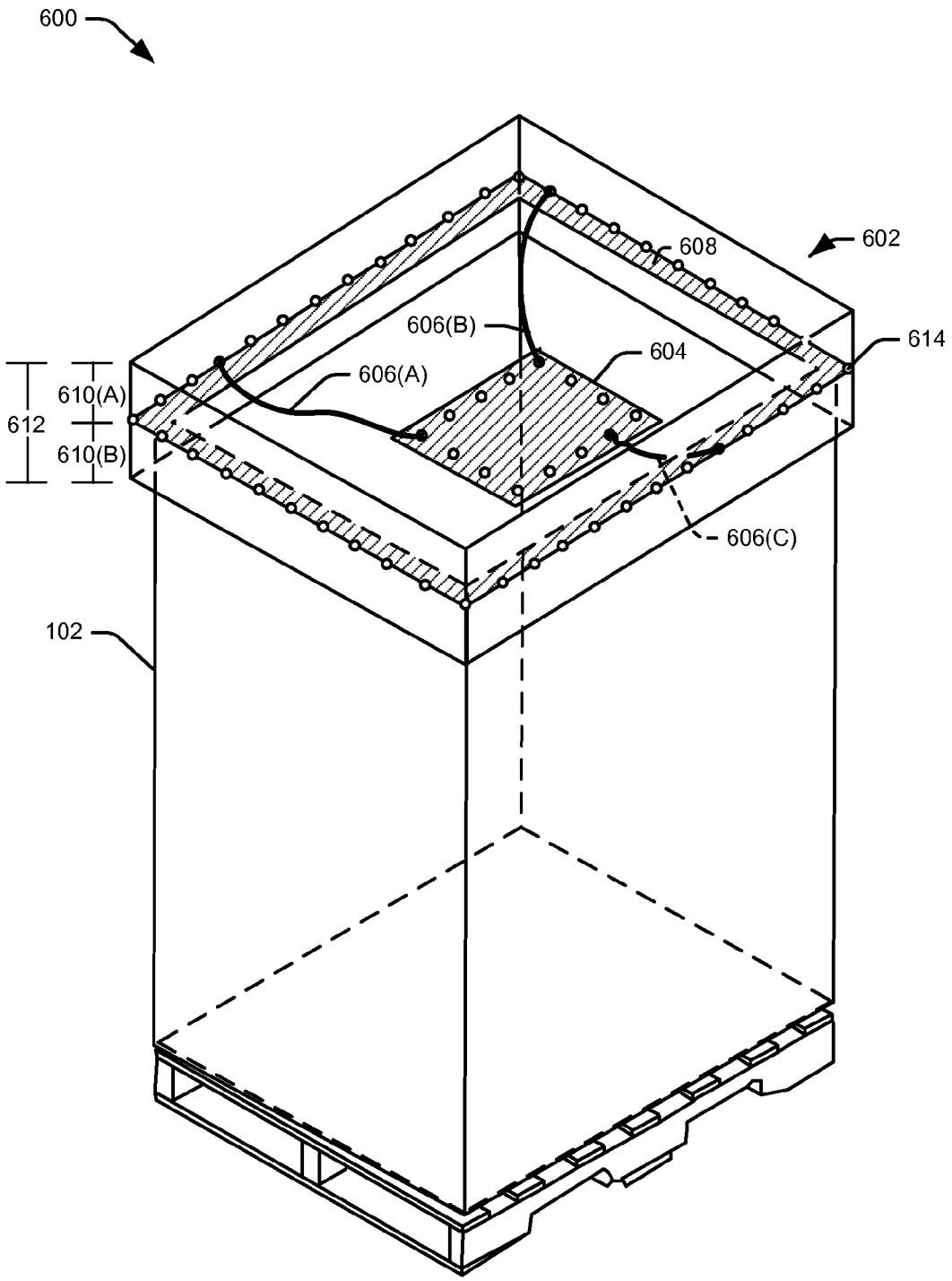
FIG. 6 illustrates an example configuration of a packaging assembly where a package interference mechanism is attached to an area where an internal lip meets a sidewall of a frame.

FIG. 6 illustrates another example package deceleration and protection system 600. In this implementation, the package deceleration and protection system 600 may comprise a packaging assembly 602 and bulk box 102. The packaging assembly 602 may comprise a package interference mechanism 604 attached by multiple elastic members 606(A)-(D) to an area where an internal lip or flange 608 meets a sidewall member 610(A) of a frame 612.

As illustrated in FIG. 6, packaging assembly 602 may include a frame 612. In some implementations, the frame 612 has two sidewall members 610(A) and 610(B) and a lip or flange 608 configured to extend in a direction that is perpendicular to an area where the sidewall members meet. Furthermore, in some implementations, the lip or flange 608 may be configured to form an internal shelf for placement of the frame 602 upon the bulk box 102.

In some implementations, the packaging assembly 602 may comprise multiple attachment points 614 on frame 612 at an area where the lip 608 meets each sidewall member 610(A) and 610(B). In other implementations, the two or more attachment points 614 on frame 612 may be positioned on either the lip 608 or on sidewall 610(A).

The packaging assembly 602 may include multiple elastic members 606(A)-(C) for attachment to the multiple attachment points 614 on frame 612. In some implementations, the elastic members 606(A)-(C) may be similar to the elastic members described above with respect to FIGS. 2 and 3(A)-3(D). In some implementations, the elastic members 606(A)-(C) may be configured to attach to corresponding attachment points (not numbered in FIG. 6.) on the package interference mechanism 604.

Figure 7:
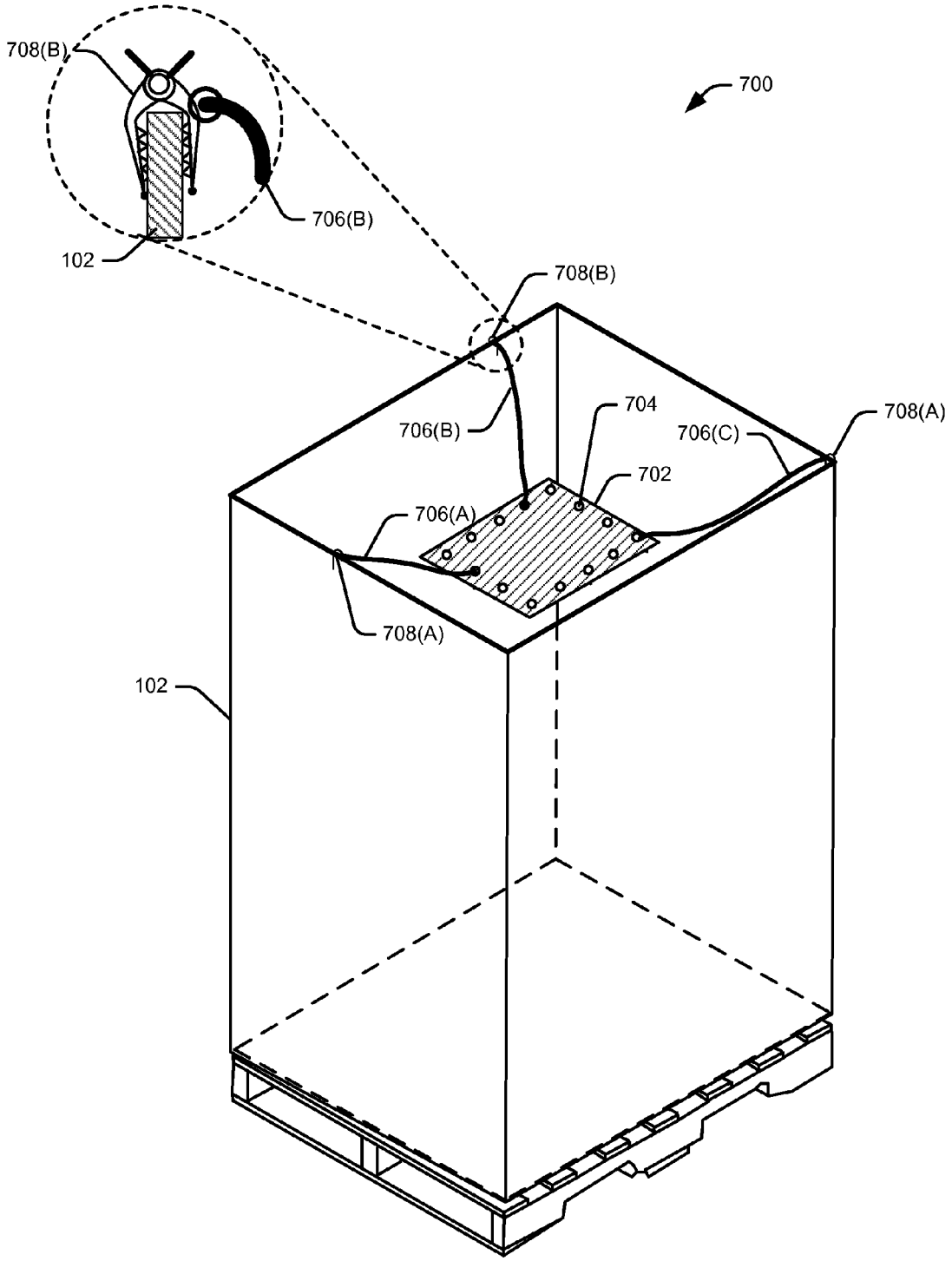
FIG. 7 illustrates an example configuration of a packaging assembly where a package interference mechanism is attached a bulk box by a clip mechanism connected to an elastic member.

FIG. 7 illustrates another example package deceleration and protection system 700. In this implementation, the package deceleration and protection system 700 may comprise a packaging interference mechanism 702 configured to attach directly to the bulk box 102 without use of a frame. In this example implementation, the packaging interference mechanism 702 is formed with multiple attachment points 704 and multiple elastic members 706(A)-(C) that attach to selected attachment points 704. As shown in FIG. 7, the package deceleration and protection system 700 has three elastic members 706(A)-(C); however, in other implementations, the system 700 may be configured with a different number of elastic members.

Each of the elastic members 706(A)-(C) may include a first end configured to couple to a top perimeter of bulk box 102 and a second end configured to couple to an attachment point 704 on the packaging interference mechanism 702. In some implementations, the first end of each elastic member 706(A)-(C) may comprise a clip mechanism 708(A)-(C) to facilitate the attachment of the first end of each of the elastic members with the top perimeter of bulk box 102. For example, FIG. 7 shows an enhanced view of clip mechanism 708(B) which may be used to couple the elastic member 708(B) to the top perimeter of bulk box 102. Clip mechanism 708(B) is merely illustrative of any number of clip mechanisms that may be used to couple each elastic member to a bulk box. In other implementations, other clip mechanisms such as connector, clamp (e.g., c-clamps, spring clamps, etc.) adapter, coupling, fastener, tie or the like are envisioned.

In some implementations, each clip mechanism 708(A)-(C) may be moved to adjust the placement and drop arresting action of the packaging interference mechanism 702. For example, a user may manipulate the placement of each clip mechanism to adjust the depth or position of the packaging interference mechanism 702 relative to the interior of the bulk box 102.

Figure 8:
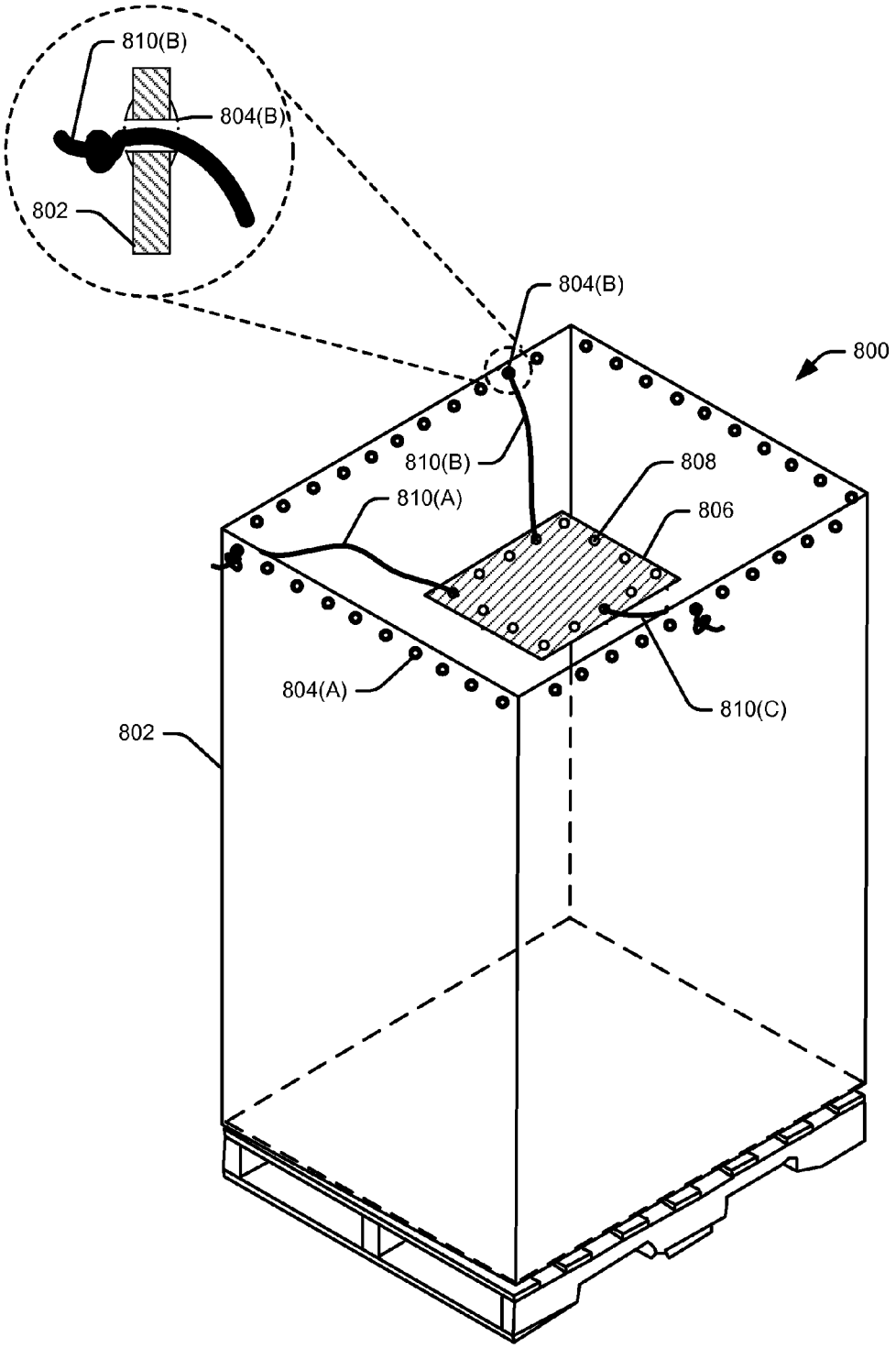
FIG. 8 illustrates an example configuration of a packaging assembly where a bulk box is modified with eyelets to allow attachment of the package interference mechanism.

FIG. 8 illustrates yet another example package deceleration and protection system 800, which includes a bulk box 802 having multiple eyelets or attachment points 804(A)-(N). Each attachment point 804(A)-(N) may be a reinforced pass-through area a predetermined distance from the top perimeter of bulk box 802. FIG. 8 illustrates the attachment points 804(A)-(N) as generally circular; however, in other implementations, the shape of the attachment points 804(A)-(N) may be square, rectangular, thin slots, etc.

The example package deceleration and protection system 800 may further include a package interference mechanism 806 having multiple attachment points 808. The package interference mechanism 806 and attachment points 808 may be similar to any of the interference mechanisms and corresponding attachment points described above.

The example package deceleration and protection system 800 has multiple elastic members 810(A)-(C) for coupling the package interference mechanism 806 to the bulk box 802. In this manner, this implementation is similar to that of FIG. 7 in that the interference mechanism 806 is connected directly to the bulk box 802 without use of a frame. In some implementations, each of the elastic members 810(A)-(C) has a first end configured to couple to pass through an attachment point 804(A)-(N) of bulk box 802 and a second end configured to attach to an attachment point 808 on the packaging interference mechanism 806. As shown in the enhanced view of the attachment point 804(B), the elastic member 810(B) may be configured to pass though the attachment point 804(B). In some implementations and as shown in FIG. 8, the elastic member 810(B) may be secured upon itself by, for example, knotting the first end of the elastic member 810(B). However, other mechanisms for securing each of the elastic members 810(A)-(C) are envisioned. A similar attachment arrangement may be used to attach the other end of the elastic member to the attachment points 808 on the interference mechanism 806.

Figure 9:
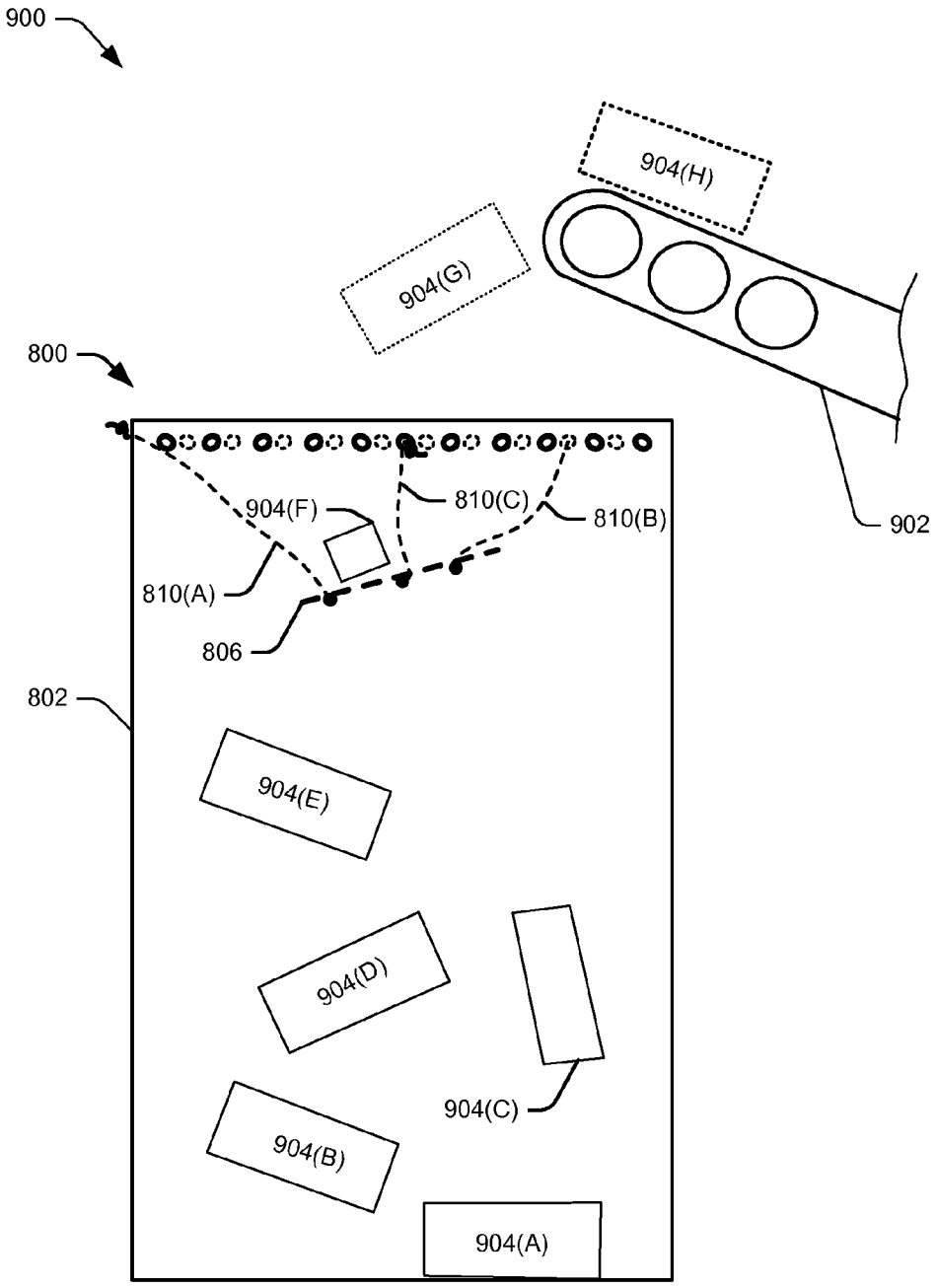
FIG. 9 illustrates an example environment where an assortment of packages are dropped from a conveyor system into a bulk box using the example packaging assembly illustrated in FIG. 8.

FIG. 9 illustrates an example environment 900 in which the example package deceleration and protection system 800 of FIG. 8 is used to receive packages from a conveyor system 902. As illustrated in FIG. 9, bulk box 802 may be positioned proximate to a drop point for the conveyor system 902. Specifically, the bulk box 802 may be positioned such that a contact surface of the package interference mechanism 806 may contact one or more packages as they drop from the conveyor system 902. In some implementations, as the one or more packages 904(A)-(H) are dropped from the conveyor system 902 drop point they may be received within the top perimeter of the bulk box 802 and contact the package interference mechanism 806.

The package deceleration and protection system 800 reduces the momentum of the packages 904(A)-(H) as each package contacts the interference mechanism 806. For instance, as illustrated in FIG. 9, package 904(F) may contact the package interference mechanism 806 during a fall from the conveyor system 902. As a result of the contact, each elastic member 810(A)-(C) may extend to absorb the force or energy of package 904(F). In some implementations, the amount of force or energy absorbed by each elastic member 810(A)-(C) may depend on a location where each package contacts the package interference mechanism 806. For example, elastic member 810(A) is shown in FIG. 9 as extending a greater distance than elastic members 810(B) and 810(C). This may be a result of package 904(F) striking the package interference mechanism 806 proximate to the point of attachment of elastic member 810(A).

FIG. 9 illustrates that the package interference mechanism 806 may move in a single direction depending on a package contact location; however, in other implementations, the package interference mechanism 806 may move in multiple directions depending on a package contact location.

Example Processes

Figure 10:
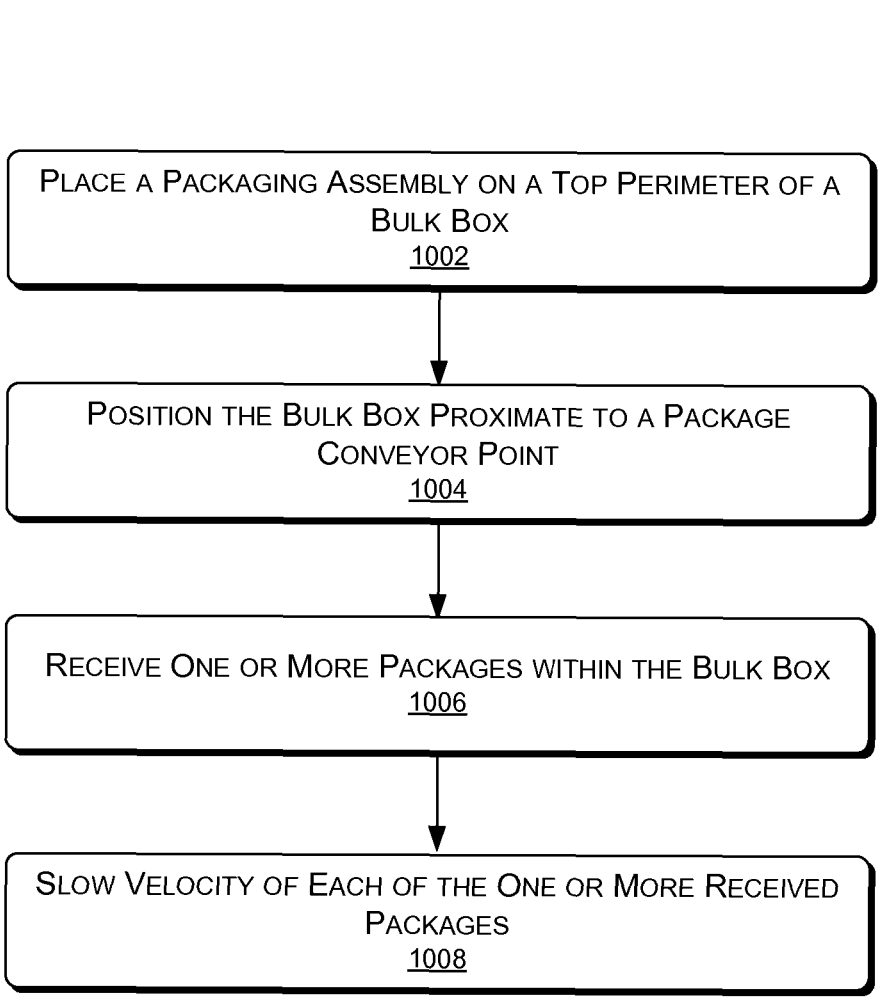
FIG. 10 is a flow diagram that illustrates an example process of loading a bulk box having an example packaging assembly.

FIG. 10 illustrates an example process 1000 for implementing the techniques described above of loading a bulk box with an assortment of packages. The process 1000 is illustrated as a logical flow graph where each operation may represent a sequence of operations. Additionally, the order in which the operations are described is not intended to be construed as a limitation, and any number of the described operation can be combined in any order and/or in parallel to implement the process.

The process 1000, at 1002, includes arranging, placing or otherwise attaching a packaging assembly on a top perimeter of a bulk box. For example, the packaging assembly described in FIGS. 2-6 may be placed on the top opening of a bulk box. The packaging assemblies described in FIGS. 7-9 may be connected directly to the bulk box.

At 1004, the bulk box coupled to the packaging assembly may be positioned proximate to a package conveyor point. Specifically, the bulk box coupled to the packaging assembly may be positioned such that the contact surface of the package interference mechanism is positioned to contact one or more packages as each package enters to the bulk box. In the context of FIG. 3A, the bulk box 102 coupled to packaging assembly 200 may be positioned under conveyor system 302 such that package 306(A) may contact the interference mechanism 204 as it enters bulk box 102.

At 1006, one or more packages of various sizes and weight may be received within the bulk box after they are dropped from the package conveyor point.

Finally, at 1008, the momentum of each package received into the bulk box is arrested by the packaging assembly. In the described implementations, the packages hit the interference mechanism and the elastic members absorb some of the energy of the packages, thereby slowing their travel. This is shown, for example, in the context of FIG. 3B, where the movement (e.g. a kinetic energy or velocity) of package 306(A) may be arrested as it contacts interference mechanism 204. In this example, the movement of package 306(A) may be absorbed in varying degrees by the elastic members 206(A)-(C) attached to the interference mechanism 204.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A method of loading a bulk box comprising:

placing a packaging assembly on a top perimeter of the bulk box, the packaging assembly comprising:

a frame comprising a sidewall configured to vertically fit over the top perimeter of the bulk box and an internal lip configured to rest horizontally on the top perimeter of the bulk box, the internal lip comprising at least a first attachment point and a second attachment point;

an interference mechanism suspended from the internal lip of the frame within a top opening of the bulk box, the interference mechanism comprising a contact surface; and a first elastic member configured to attach to the first attachment point of the internal lip of the frame and the interference mechanism;

a second elastic member configured to attach to the second attachment point of the internal lip of the frame and to the interference mechanism; and positioning the bulk box proximate to a conveyor system, wherein the contact surface of the interference mechanism is positioned to contact one or more packages that enter the bulk box, wherein the one or more packages are transferred to the bulk box from the conveyor system, wherein a velocity of individual packages of the one or more packages is reduced as the package contacts the contact surface of the interference mechanism and travels past the interference mechanism towards a bottom surface of the bulk box, and wherein the first elastic member and the second elastic member at least partially absorb energy of the one or more packages.

2. The method as recited in claim 1, wherein the interference mechanism comprises a first attachments point for attachment of a second end of the first elastic member and a second attachments point for attachment of a second end of the second elastic member.

3. The method as recited in claim 2, wherein the first elastic member is moveable among the first attachments point and the second attachment point on the internal lip of the frame and among the first attachment point and the second attachment points on the interference mechanism to reposition the contact surface of the interference mechanism within the top opening of the bulk box.

4. The method as recited in claim 1, wherein the interference mechanism comprises one of a corrugated plastic, wood, metal or fabric and the contact surface of the interference mechanism has a shape that is one of a rectangle, square, circle, octagon, or trapezoid.

5. The method as recited in claim 1, wherein the two or more elastic members comprises one of a bungee cord, a rubber band, or a spring mechanism.

6. A package deceleration system comprising:

a frame member for alignment on a perimeter of an opening of a box, the frame member including a flange comprising multiple attachment points, wherein the flange rests on the perimeter of the opening of the box;

an interference mechanism suspended from the frame member within an opening of the box to impede one or more packages as the one or more packages travel towards a bottom surface of the box; and multiple elastic members, wherein individual ones of the multiple elastic members are configured to attached to individual ones of the multiple attachment points of the flange to connect the interference mechanism with the frame member, wherein the interference mechanism is displaced as the one or more packages contact and travel past the interference mechanism as the one or more packages enter the box.

7. The system as recited in claim 6, wherein the frame member further comprises a flange for resting on the box.

8. The system as recited in claim 6, wherein the frame member further comprises an internal flange for resting on the box and a side wall extending in at least one direction perpendicular to the internal flange at a perimeter of the opening of the box.

9. The system as recited in claim 6, wherein the multiple elastic members are further configured to absorb kinetic energy of the one or more packages as the one or more packages contact the interference mechanism.

10. The system as recited in claim 6, wherein the multiple elastic members comprise one of a bungee cord, a rubber band, or a spring mechanism.

11. The system as recited in claim 6, wherein the interference mechanism comprises multiple attachment points to which the multiple elastic members are configured to be attached.

12. The system as recited in claim 11, wherein the multiple elastic members are configured to be reattached among various combinations of the multiple attachment points on the flange and the interference mechanism to adjust a position of the interference mechanism relative to the frame.

13. The system as recited in claim 12, wherein adjustment of the interference mechanism relative to the frame alters a direction of the one or more packages after contact with the interference mechanism as individual packages of the one or more packages travel towards the bottom surface of the box.

14. A package deceleration system comprising:

a frame for resting on an opening of a box, the frame including a flange comprising a first attachment point and a second attachment point, wherein the flange rests on the opening of the box;

a platten member having a contact surface; and an elastic attachment assembly, the elastic attachment assembly including a first elastic member and a second elastic member to couple the platten member to the first attachment point and the second attachment point of the flange, respectively, and to suspend the platten member substantially at a center position within the opening in the box so that a package that enters the box engages the contact surface of the platten member such that the package slows down and slides off the platen member towards a bottom surface of the box.

15. The package deceleration system as recited in claim 14, wherein the elastic attachment assembly is configurable to adjust a position, a location, and an orientation of the platten member relative to the box.

16. A packaging assembly comprising:

a box having a top end for receiving one or more packages;

two or more extendable attachment mechanisms, each of the attachment mechanism having a first end and a second end, the first end configured to couple to one of multiple attachment points on a flange of a frame, wherein the flange rests on the top end of the box; and a drop arrestor suspended within an opening at the top end of the box at a central position and attached to the second ends of the two or more extendable attachment mechanisms, the drop arrestor configured to impede movement of the one or more packages as the one or more packages contact the drop arrestor and travel past the drop arrestor towards a bottom end of the box.

17. The packaging assembly as recited in claim 16, wherein the two or more extendable attachment mechanisms are further configured to absorb a kinetic energy of the one or more packages as the one or more packages make contact with the drop arrestor.

18. The packaging assembly as recited in claim 16, wherein the drop arrestor comprises multiple attachment points for attachment to the second ends of the two or more extendable attachment mechanisms.

19. The packaging assembly as recited in claim 16, wherein a first extendable attachment mechanism of the two or more extendable attachment mechanisms has a first length or a first tension and a second extendable attachment mechanism of the two or more extendable attachment mechanisms has a second length or a second tension.

20. The packaging assembly as recited in claim 16, wherein the frame comprises multiple attachment points for attachment to the first ends of the two or more extendable attachment mechanisms.

* * * * *